US010206034B2

(12) United States Patent
Mitsufuji

(10) Patent No.: US 10,206,034 B2
(45) Date of Patent: Feb. 12, 2019

(54) SOUND FIELD COLLECTING APPARATUS AND METHOD, SOUND FIELD REPRODUCING APPARATUS AND METHOD

(71) Applicant: SONY CORPORATION, Tokyo (JP)

(72) Inventor: Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/123,340

(22) PCT Filed: Feb. 27, 2015

(86) PCT No.: PCT/JP2015/055742
§ 371 (c)(1),
(2) Date: Sep. 2, 2016

(87) PCT Pub. No.: WO2015/137146
PCT Pub. Date: Sep. 17, 2015

(65) Prior Publication Data

US 2017/0070815 A1 Mar. 9, 2017

(30) Foreign Application Priority Data

Mar. 12, 2014 (JP) ..... 2014-048428

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/403* (2013.01); *H04R 2430/03* (2013.01); *H04R 2430/20* (2013.01); *H04S 2420/13* (2013.01)

(58) Field of Classification Search
CPC . G10L 19/008; G10L 19/032; G10L 19/0204; G10L 25/51
USPC ..... 381/92, 20, 22, 23, 56
See application file for complete search history.

(56) References Cited

U.S. PATENT DOCUMENTS

2007/0223708 A1* 9/2007 Villemoes ..... H04S 3/004 381/17
2011/0120222 A1* 5/2011 Scholte ..... G01H 3/125 73/603
2012/0051548 A1* 3/2012 Visser ..... G10L 21/0208 381/56

FOREIGN PATENT DOCUMENTS

JP 2013-150027 A 8/2013

* cited by examiner

*Primary Examiner* — Alexander Jamal
(74) *Attorney, Agent, or Firm* — Chip Law Group

(57) ABSTRACT

The present technology relates to a sound field collecting apparatus and method, a sound field reproducing apparatus and method and a program which enable a sound field to be reproduced accurately at lower cost. Each linear microphone array outputs a sound collection signal obtained by collecting a sound field. A spatial frequency analysis unit performs spatial frequency transform on each sound collection signal to calculate spatial frequency spectra. A space shift unit performs space shift on the spatial frequency spectra so that central coordinates of the linear microphone arrays become the same, to obtain spatially shifted spectra. A space domain signal mixing unit mixes a plurality of spatially shifted spectra to obtain a single microphone mixed signal. By mixing the sound collection signals of the plurality of linear microphone arrays in this manner, it is possible to reproduce a sound field accurately at low cost. The present technology can be applied to a sound field reproducer.

13 Claims, 6 Drawing Sheets

SOUND FIELD COLLECTING APPARATUS AND METHOD, SOUND FIELD REPRODUCING APPARATUS AND METHOD

CROSS REFERENCE TO RELATED APPLICATIONS

This application is a U.S. National Phase of International Patent Application No. PCT/JP2015/055742 filed on Feb. 27, 2015, which claims priority benefit of Japanese Patent Application No. JP 2014-048428 filed in the Japan Patent Office on Mar. 12, 2014. Each of the above-referenced applications is hereby incorporated herein by reference in its entirety.

TECHNICAL FIELD

The present technology relates to a sound field collecting apparatus and method, a sound field reproducing apparatus and method, and a program, and, more particularly, to a sound field collecting apparatus and method, a sound field reproducing apparatus and method and a program which enable a sound field to be reproduced accurately at lower cost.

BACKGROUND ART

In related art, a wave front synthesis technology is known which collects wave fronts of sound in a sound field using a plurality of microphones and reproduces the sound field based on obtained sound collection signals.

For example, as a technology regarding wave front synthesis, a technology has been proposed in which sound sources are disposed in virtual space assuming that object sound sources are collected, and sound from each sound source is reproduced at a linear speaker array configured with a plurality of speakers disposed on a line (see, for example, Non-Patent Literature 1).

Further, a technology has been also proposed which applies the technology disclosed in Non-Patent Literature 1 to a linear microphone array configured with a plurality of microphones disposed on a line (see, for example, Non-Patent Literature 2). In the technology disclosed in Non-Patent Literature 2, a sound pressure gradient is generated from sound collection signals which are obtained by collecting sound with one linear microphone array through processing on a spatial frequency, and a sound field is reproduced with one linear speaker array.

Use of a linear microphone array in this manner makes it possible to perform processing in a frequency domain by performing time-frequency transform on sound collection signals, so that it is possible to reproduce a sound field with an arbitrary linear speaker array through resampling at a spatial frequency.

CITATION LIST

Non-Patent Literature

Non-Patent Literature 1: Jens Adrens, Sascha Spors, "Applying the Ambisonics Approach on Planar and Linear Arrays of Loudspeakers," in 2nd International Symposium on Ambisonics and Spherical Acoustics Non-Patent Literature 2: Shoichi Koyama et al., "Design of Transform Filter for Sound Field Reproduction using Micorphone Array and Loudspeaker Array," IEEE Workshop on Applications of Signal Processing to Audio and Acoustics 2011

SUMMARY OF INVENTION

Technical Problem

However, with the technology using a linear microphone array, to try to reproduce a sound field more accurately, a higher-performance linear microphone array is required as a linear microphone array to be used for collecting wave fronts. Such a high-performance linear microphone array is expensive, and it is difficult to reproduce a sound field accurately at low cost.

The present technology has been made in view of such circumstances, and is directed to reproducing a sound field accurately at lower cost.

Solution to Problem

According to a first aspect of the present technology, there is provided a sound field collecting apparatus including: a first time-frequency analysis unit configured to perform time-frequency transform on a sound collection signal obtained through sound collection by a first linear microphone array including microphones having first characteristics to calculate a first time-frequency spectrum; a first spatial frequency analysis unit configured to perform spatial frequency transform on the first time-frequency spectrum to calculate a first spatial frequency spectrum; a second time-frequency analysis unit configured to perform time-frequency transform on a sound collection signal obtained through sound collection by a second linear microphone array including microphones having second characteristics different from the first characteristics to calculate a second time-frequency spectrum; a second spatial frequency analysis unit configured to perform spatial frequency transform on the second time-frequency spectrum to calculate a second spatial frequency spectrum; and a space domain signal mixing unit configured to mix the first spatial frequency spectrum and the second spatial frequency spectrum to calculate a microphone mixed signal.

A space shift unit configured to shift a phase of the first spatial frequency spectrum according to positional relationship between the first linear microphone array and the second linear microphone array can be further included. The space domain signal mixing unit can mix the second spatial frequency spectrum and the first spatial frequency spectrum whose phase is shifted.

The space domain signal mixing unit can perform zero padding on the first spatial frequency spectrum or the second spatial frequency spectrum so that the number of points of the first spatial frequency spectrum becomes the same as the number of points of the second spatial frequency spectrum.

The space domain signal mixing unit can perform mixing by performing weighted addition on the first spatial frequency spectrum and the second spatial frequency spectrum using a predetermined mixing coefficient.

The first linear microphone array and the second linear microphone array can be disposed on the same line.

The number of microphones included in the first linear microphone array can be different from the number of microphones included in the second linear microphone array.

A length of the first linear microphone array can be different from a length of the second linear microphone array.

An interval between the microphones included in the first linear microphone array can be different from an interval between the microphones included in the second linear microphone array.

According to the first aspect of the present technology, there is provided a sound field collecting method or a program including steps of: performing time-frequency transform on a sound collection signal obtained through sound collection by a first linear microphone array including microphones having first characteristics to calculate a first time-frequency spectrum; performing spatial frequency transform on the first time-frequency spectrum to calculate a first spatial frequency spectrum; performing time-frequency transform on a sound collection signal obtained through sound collection by a second linear microphone array including microphones having second characteristics different from the first characteristics to calculate a second time-frequency spectrum; performing spatial frequency transform on the second time-frequency spectrum to calculate a second spatial frequency spectrum; and mixing the first spatial frequency spectrum and the second spatial frequency spectrum to calculate a microphone mixed signal.

In the first aspect of the present technology, time-frequency transform is performed on a sound collection signal obtained through sound collection by a first linear microphone array including microphones having first characteristics to calculate a first time-frequency spectrum; spatial frequency transform is performed on the first time-frequency spectrum to calculate a first spatial frequency spectrum; time-frequency transform is performed on a sound collection signal obtained through sound collection by a second linear microphone array including microphones having second characteristics different from the first characteristics to calculate a second time-frequency spectrum; spatial frequency transform is performed on the second time-frequency spectrum to calculate a second spatial frequency spectrum; and the first spatial frequency spectrum and the second spatial frequency spectrum are mixed to calculate a microphone mixed signal.

According to a second aspect of the present technology, there is provided a sound field reproducing apparatus including: a spatial resampling unit configured to perform inverse spatial frequency transform on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and a time-frequency synthesis unit configured to perform time-frequency synthesis on the time-frequency spectrum to generate a drive signal for reproducing a sound field by the linear speaker array.

According to the second aspect of the present technology, there is provided a sound field reproducing method or a program including steps of: performing inverse spatial frequency transform on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and performing time-frequency synthesis on the time-frequency spectrum to generate a drive signal for reproducing a sound field by the linear speaker array.

In the second aspect of the present technology, inverse spatial frequency transform is performed on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and time-frequency synthesis is performed on the time-frequency spectrum to generate a drive signal for reproducing a sound field by the linear speaker array.

Advantageous Effects of Invention

According to a first aspect and a second aspect of the present technology, it is possible to reproduce a sound field accurately at lower cost.

Note that advantageous effects of the present technology are not limited to those described here and may be any advantageous effect described in the present disclosure.

DESCRIPTION OF EMBODIMENTS

Embodiments to which the present technology is applied will be described below with reference to the drawings.

First Embodiment

<Concerning Present Technology>

The present technology is a technology in which wave fronts of sound are collected using a linear microphone array configured with a plurality of microphones arranged on a line in real space, and a sound field is reproduced based on sound collection signals obtained as a result of the sound collection with a linear speaker array configured with a plurality of speakers arranged on a line.

When a sound field is reproduced using a linear microphone array and a linear speaker array, to try to reproduce a sound field more accurately, a higher-performance linear microphone array is required, and such a high-performance linear microphone array is expensive.

Figure 1:
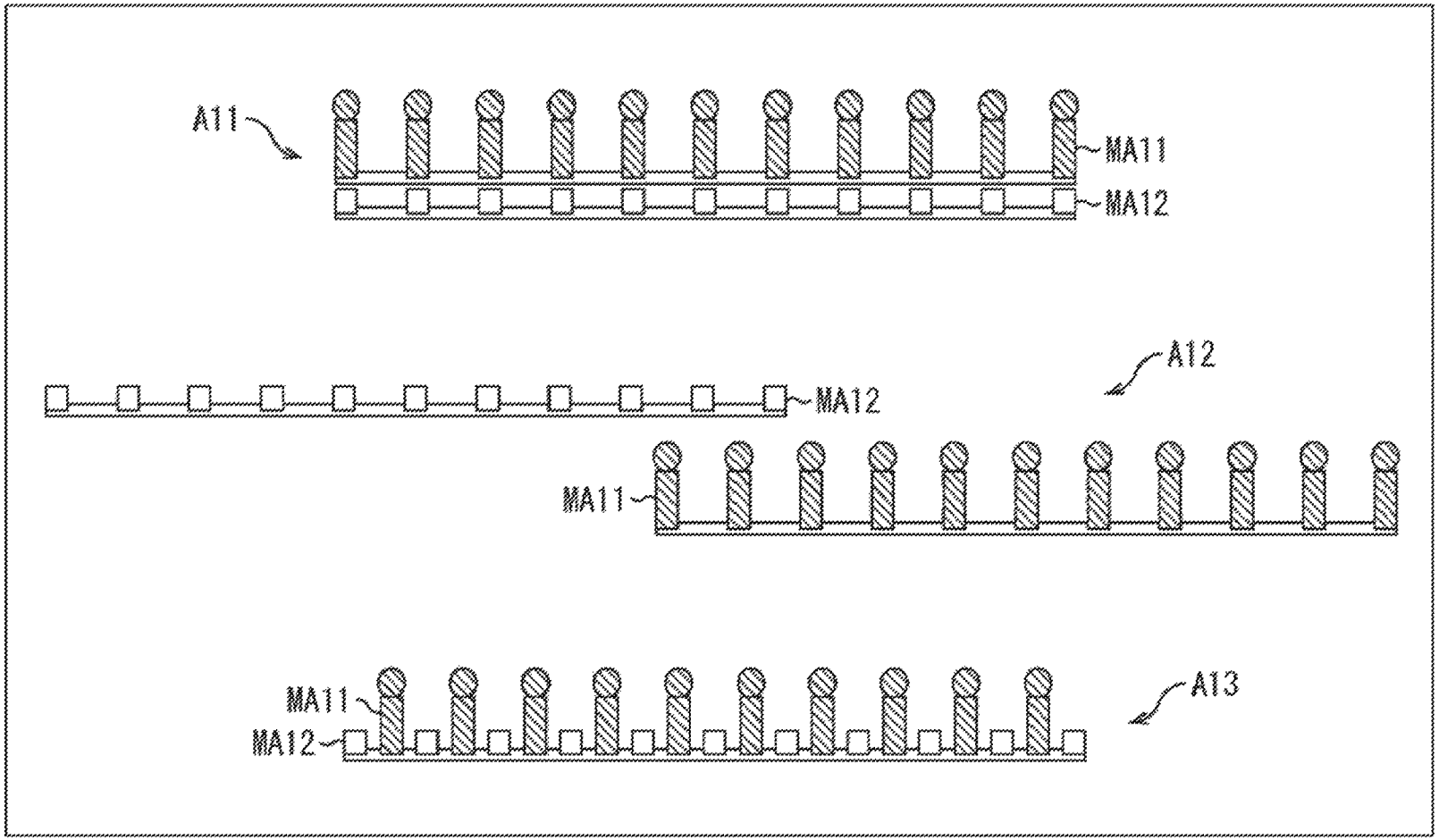
FIG. 1 is a diagram explaining sound collection by a plurality of linear microphone arrays according to an embodiment of the present technology.

Therefore, for example, as illustrated in FIG. 1, sound collection using a linear microphone array MA11 and a linear microphone array MA12 which have characteristics different from each other will be considered.

Here, the linear microphone array MA11 is configured with, for example, microphones with relatively favorable acoustic characteristics, and microphones included in the linear microphone array MA11 are arranged on a line at regular intervals. Commonly, because a size (volume) of a microphone with favorable acoustic characteristics is large, it is difficult to arrange microphones included in a linear microphone array at narrow intervals.

Further, the microphone array MA12 is configured with microphones which are less favorable in acoustic characteristics, but smaller than, for example, microphones included in the linear microphone array MA11, and the microphones included in the linear microphone array MA12 are also arranged on a line at regular intervals.

By using a plurality of linear microphone arrays which have characteristics different from each other in this manner, it is possible to, for example, expand a dynamic range or a frequency range of a sound field to be reproduced or improve spatial frequency resolution of sound collection signals. By this means, it is possible to reproduce a sound field accurately at lower cost.

When two linear microphone arrays are used to collect sound, for example, as indicated with an arrow A11, it is physically impossible to dispose microphones included in the linear microphone array MA11 and microphones included in the linear microphone array MA12 on the same coordinates (the same positions).

Further, when, as indicated with an arrow A12, the linear microphone array MA11 and the linear microphone array MA12 are not located on the same line, because central coordinates of sound fields collected at respective linear microphone arrays are different, a single sound field cannot be reproduced with a single linear speaker array.

Still further, as indicated with an arrow A13, by alternately disposing the microphones included in the linear microphone array MA11 and the microphones included in the linear microphone array MA12 on a line so that the microphones do not overlap with each other, it is possible to arrange the central coordinates of sound fields collected at the respective linear microphone arrays at the same position.

However, in this case, a transmission amount of sound collection signals increases by an amount corresponding to the number of linear microphone arrays, which results in increase in transmission cost.

Figure 2:
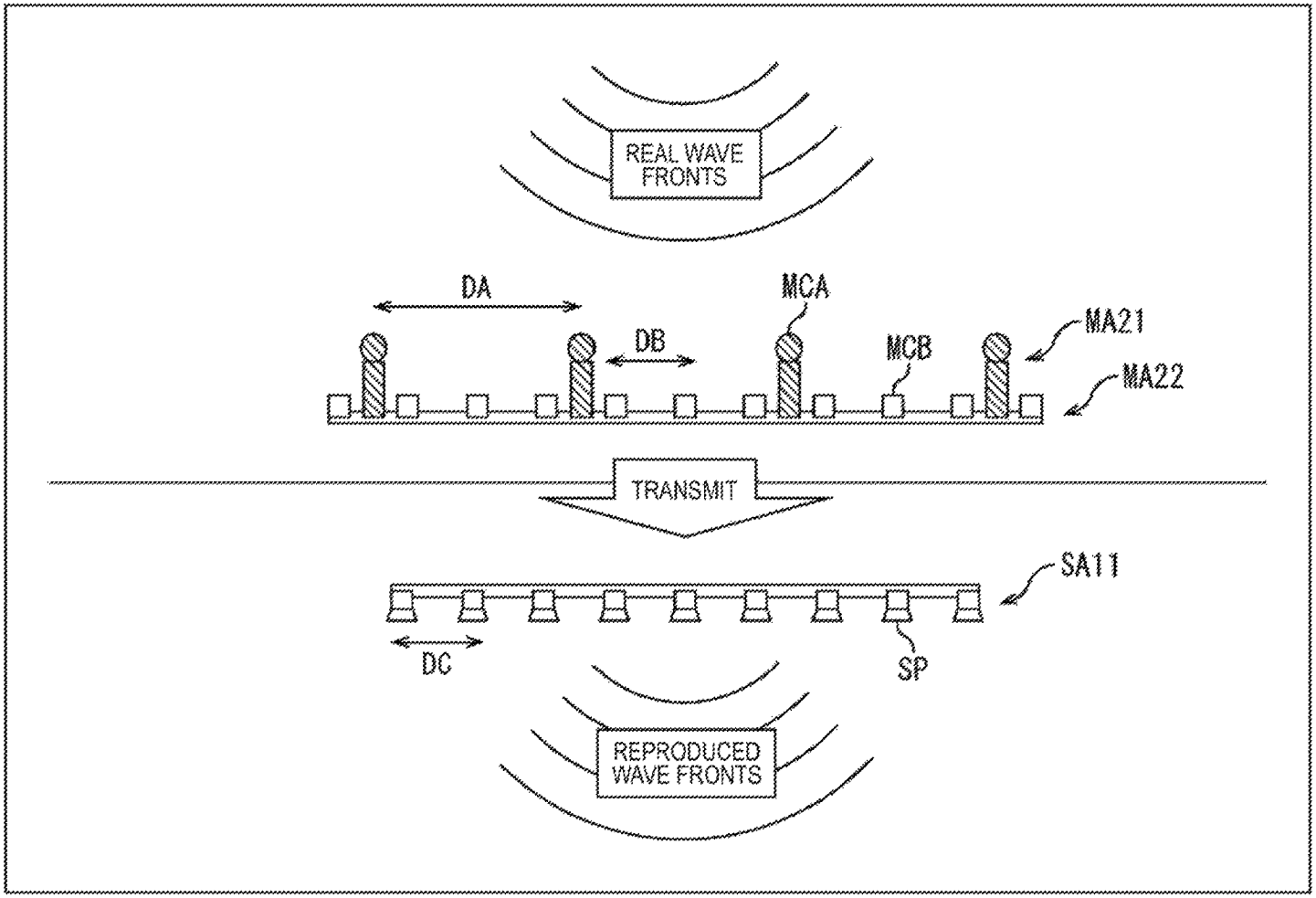
FIG. 2 is a diagram explaining sound field reproduction according to the present technology.

Therefore, in the present technology, for example, as illustrated in FIG. 2, a plurality of sound collection signals are mixed and transmitted, the sound collection signals being collected by a plurality of linear microphone arrays configured by disposing a plurality of microphones having different characteristics such as acoustic characteristics and a volume (size) in real space at different intervals or at regular intervals on the same line. Then, at a reception side of the sound collection signals, a drive signal for a linear speaker array is generated so that a sound field in real space is equivalent to a sound field in reproduction space.

Specifically, in FIG. 2, a linear microphone array MA21 configured with a plurality of microphones MCA and a linear microphone array MA22 configured with a plurality of microphone MCB having different characteristics from those of the microphones MCA are arranged on the same line in real space.

In this example, the microphones MCA are arranged at regular intervals of DA, and the microphones MCB are arranged at regular intervals of DB. Further, the microphones MCA and the microphones MCB are arranged so that arrangement positions (coordinates) do not physically overlap with each other.

Note that, in FIG. 2, a reference sign MCA is assigned to only part of microphones included in the linear microphone array MA21. In a similar manner, a reference sign MCB is assigned to only part of microphones included in the linear microphone array MA22.

Further, in reproduction space in which a sound field in real space is to be reproduced, a linear speaker array SA11 configured with a plurality of speakers SP arranged on a line at intervals of DC is disposed, and the interval DC at which the speakers SP are arranged is different from the above-described interval DA or DB. Note that, in FIG. 2, a reference sign SP is assigned to only part of speakers included in the linear speaker array SA11.

In this manner, in real space, real wave fronts of sound are collected by these two types of linear microphone array MA21 and linear microphone array MA22 which have different characteristics, and the obtained sound signals are used as sound collection signals.

Because intervals at which microphones included in the linear microphone arrays are arranged are different between these two types of linear microphone arrays, it can be regarded that spatial sampling frequencies of the sound collection signals obtained at the respective linear microphone arrays are different.

Therefore, the sound collection signals obtained for each linear microphone array cannot be simply mixed in a time-frequency domain. That is, because positions of microphones, that is, positions at which real wave fronts are recorded (collected) are different for each linear microphone array, and sound fields do not overlap, the sound collection signals cannot be simply mixed in a time-frequency domain.

Therefore, in the present technology, each sound collection signal is orthogonally transformed to a spatial frequency domain independent of a coordinate position using an orthonormal base, and spectra are mixed in the spatial frequency domain.

Further, when central coordinates of the two types of linear microphone arrays configured with two types of microphones are different, the sound collection signals are mixed after central coordinates of the linear microphone arrays are made the same by performing phase shift on the sound collection signals in a spatial frequency domain. Here, it is assumed that the central coordinate of each linear microphone array is, for example, an intermediate position of two microphones located at both ends of the linear microphone array.

When the sound collection signals of the linear microphone array MA21 and the sound collection signals of the linear microphone array MA22 are mixed in this manner, a microphone mixed signal obtained through the mixture is transmitted to reproduction space. Then, inverse spatial frequency transform is performed on the transmitted microphone mixed signal to be transformed into a signal at a spatial sampling frequency corresponding to the interval DC of the speakers SP of the linear speaker array SA11, and the obtained signal is made a speaker drive signal for the linear speaker array SA11. Sound is reproduced at the linear speaker array SA11 based on the speaker drive signal obtained in this manner, and reproduced wave fronts are output. That is, the sound field in real space is reproduced.

As described above, a sound field reproducer of the present technology which uses a plurality of linear microphone arrays as a sound field collecting apparatus and which uses a single linear speaker array as a sound reproducing apparatus has particularly the following feature (1) to (3).

Feature (1)

For example, by configuring one linear microphone array with small silicon microphones and arranging a plurality of the small silicon microphones at intervals narrower than those for other microphones, it is possible to increase spatial frequency resolution of sound collection signals and reduce space aliasing in a reproduction area. Particularly, if it is possible to provide small silicon microphones at low cost, the sound field reproducer of the present technology has a greater advantage.

Feature (2)

By configuring a plurality of linear microphone arrays by combining a plurality of microphones having different dynamic ranges or frequency ranges, it is possible to expand a dynamic range or a frequency range of sound to be reproduced.

Feature (3)

By performing spatial frequency transform on sound collection signals of a plurality of linear microphone arrays, mixing the obtained signals, and transmitting only required components in a spatial frequency band of the obtained microphone mixed signal, it is possible to reduce transmission cost.

<Configuration Example of Sound Field Reproducer>

A specific embodiment to which the present technology is applied will be described next as an example of a case where the present technology is applied to the sound field reproducer.

Figure 3:
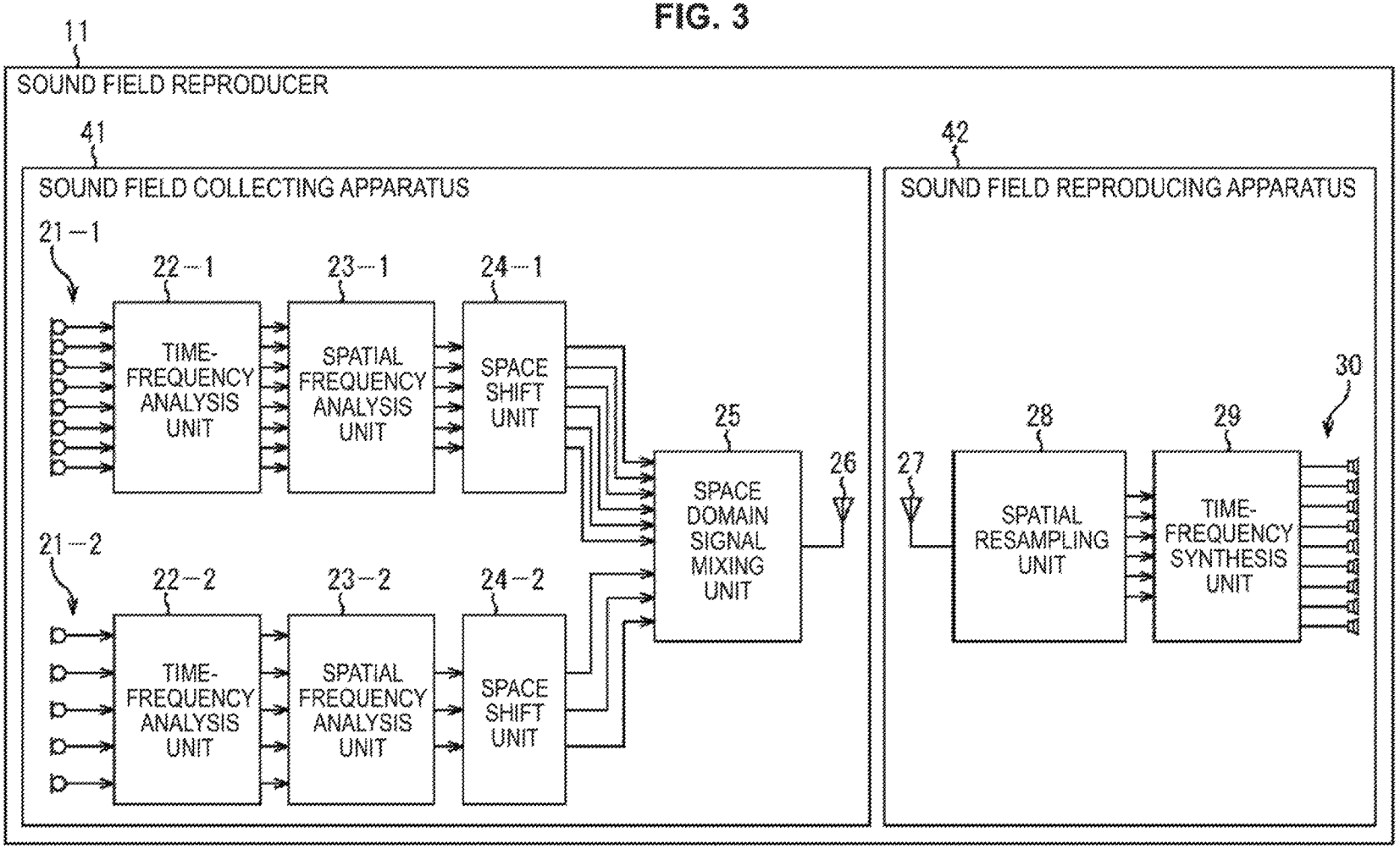
FIG. 3 is a diagram illustrating a configuration example of a sound field producer according to an embodiment of the present technology.

FIG. 3 is a diagram illustrating a configuration example of an embodiment of the sound field reproducer to which the present technology is applied.

The sound field reproducer 11 has a linear microphone array 21-1, a linear microphone array 21-2, a time-frequency analysis unit 22-1, a time-frequency analysis unit 22-2, a spatial frequency analysis unit 23-1, a spatial frequency analysis unit 23-2, a space shift unit 24-1, a space shift unit 24-2, a space domain signal mixing unit 25, a communication unit 26, a communication unit 27, a spatial resampling unit 28, time-frequency synthesis unit 29 and a linear speaker array 30.

In this example, the linear microphone array 21-1, the linear microphone array 21-2, the time-frequency analysis unit 22-1, the time-frequency analysis unit 22-2, the spatial frequency analysis unit 23-1, the spatial frequency analysis unit 23-2, the space shift unit 24-1, the space shift unit 24-2, the space domain signal mixing unit 25 and the communication unit 26 are disposed in real space in which real wave fronts of sound are collected. A sound field collecting apparatus 41 is realized with these linear microphone array 21-1 to the communication unit 26.

Meanwhile, in reproduction space in which real wave fronts are to be reproduced, the communication unit 27, the spatial resampling unit 28, the time-frequency synthesis unit 29 and the linear speaker array 30 are disposed, and a sound field reproducing apparatus 42 is realized with these communication unit 27 to the linear speaker array 30.

The linear microphone array 21-1 and the linear microphone array 21-2 collect real wave fronts of sound in real space and supply sound collection signals obtained as a result of the collection to the time-frequency analysis unit 22-1 and the time-frequency analysis unit 22-2.

Here, microphones included in the linear microphone array 21-1 and microphones included in the linear microphone array 21-2 are disposed on the same line.

Further, the linear microphone array 21-1 and the linear microphone array 21-2 have characteristics different from each other.

Specifically, for example, the microphones included in the linear microphone array 21-1 and the microphones included in the linear microphone array 21-2 are different in characteristics such as acoustic characteristics and a volume (size). Further, the number of the microphones included in the linear microphone array 21-1 is made different from the number of the microphones included in the linear microphone array 21-2.

Still further, an interval at which the microphones included in the linear microphone array 21-1 are arranged is different from an interval at which the microphones included in the linear microphone array 21-2 are arranged. Further, for example, the length of the linear microphone array 21-1 is different from the length of the linear microphone array 21-2. Here, the length of the linear microphone array is the length in a direction the microphones included in the linear microphone array are arranged.

In this manner, these two linear microphone arrays are linear microphone arrays having different various characteristics such as characteristics of the microphones themselves, the number of microphones and an interval at which microphones are arranged.

Note that, hereinafter, when it is not necessary to particularly distinguish between the linear microphone array 21-1 and the linear microphone array 21-2, they will be also simply referred to as a linear microphone array 21. Further, while an example will be described here where real wave fronts are collected using two types of linear microphone arrays 21, it is also possible to use three or more types of linear microphone arrays 21.

The time-frequency analysis unit 22-1 and the time-frequency analysis unit 22-2 perform time-frequency transform on sound collection signals supplied from the linear microphone array 21-1 and the linear microphone array 21-2 and supply the obtained time-frequency spectra to the spatial frequency analysis unit 23-1 and the spatial frequency analysis unit 23-2.

Note that, hereinafter, when it is not necessary to particularly distinguish between he time-frequency analysis unit 22-1 and the time-frequency analysis unit 22-2, they will be also simply referred to as a time-frequency analysis unit 22.

The spatial frequency analysis unit 23-1 and the spatial frequency analysis unit 23-2 perform spatial frequency transform on time-frequency spectra supplied from the time-frequency analysis unit 22-1 and the time-frequency analysis unit 22-2 and supply spatial frequency spectra obtained as a result of the spatial frequency transform to the space shift unit 24-1 and the space shift unit 24-2.

Note that, hereinafter, when it is not necessary to particularly distinguish between the spatial frequency analysis unit 23-1 and the spatial frequency analysis unit 23-2, they will be also simply referred to as a spatial frequency analysis unit 23.

The space shift unit 24-1 and the space shift unit 24-2 make central coordinates of the linear microphone array 21 the same by spatially shifting the spatial frequency spectra supplied from the spatial frequency analysis unit 23-1 and the spatial frequency analysis unit 23-2 and supply the obtained spatially shifted spectra to the space domain signal mixing unit 25.

Note that, hereinafter, when it is not necessary to particularly distinguish between the space shift unit 24-1 and the space shift unit 24-2, they will be also simply referred to as a space shift unit 24.

The space domain signal mixing unit 25 mixes the spatially shifted spectra supplied from the space shift unit 24-1 and the space shift unit 24-2 and supplies a single microphone mixed signal obtained as a result of the mixture to the communication unit 26. The communication unit 26 transmits the microphone mixed signal supplied from the space domain mixing unit 25 through, for example, wireless communication, or the like. Note that transmission (transfer) of the microphone mixed signal is not limited to transmission through wireless communication, but may be transmission through wired communication or transmission through communication which is combination of wireless communication and wired communication.

The communication unit 27 receives the microphone mixed signal transmitted from the communication unit 26 and supplies the microphone mixed signal to the spatial resampling unit 28. The spatial resampling unit 28 generates a time-frequency spectrum which is a drive signal for reproducing real wave fronts in real space with the linear speaker array 30 based on the microphone mixed signal supplied from the communication unit 27 and supplies the time-frequency spectrum to the time-frequency synthesis unit 29.

The time-frequency synthesis unit 29 performs time-frequency synthesis or frame synthesis on the time-frequency spectrum supplied from the spatial resampling unit 28 and supplies a speaker drive signal obtained as a result of the synthesis to the linear speaker array 30. The linear speaker array 30 reproduces sound based on the speaker drive signal supplied from the time-frequency synthesis unit 29. By this means, a sound field (real wave fronts) in real space is reproduced.

Here, components included in the sound field reproducer 11 will be described in more detail.

(Time-Frequency Analysis Unit)

The time-frequency analysis unit 22 analyzes time-frequency information of a sound collection signal $s(n_{mic}, t)$ obtained at each microphone (microphone sensor) included in the linear microphone array 21 for I linear microphone arrays 21 having different characteristics such as acoustic characteristics and a volume.

Note that $n_{mic}$ in the sound collection signal $s(n_{mic}, t)$ is a microphone index indicating each microphone included in the linear microphone array 21, and the microphone index $n_{mic}=0, \ldots, N_{mic}-1$. Note that $N_{mic}$ indicates the number of microphones included in the linear microphone array 21. Further, t in the sound collection signal $s(n_{mic}, t)$ indicates time. In the example of FIG. 3, the number of linear microphone arrays 21 I=2.

The time-frequency analysis unit 22 performs time frame division of a fixed size on the sound collection signal $s(n_{mic}, t)$ to obtain an input frame signal $s_{fr}(n_{mic}, n_{fr}, l)$. The time-frequency analysis unit 22 then multiplies the input frame signal $s_{fr}(n_{mic}, n_{fr}, l)$ by a window function $w_T(n_{fr})$ indicated in the following equation (1) to obtain a window function applied signal $s_w(n_{mic}, n_{fr}, l)$. That is, calculation in the following equation (2) is performed to calculate the window function applied signal $s_w(n_{mic}, n_{fr}, l)$.

[Math. 1]

$$w_T(n_{fr}) = \left(0.5 - 0.5\cos\left(2\pi\frac{n_{fr}}{N_{fr}}\right)\right)^{0.5} \tag{1}$$

[Math. 2]

$$s_w(n_{mic}, n_{fr}, l) = w_T(n_{fr}) s_{fr}(n_{mic}, n_{fr}, l) \tag{2}$$

Here, in the equation (1) and the equation (2), $n_{fr}$ indicates a time index, and the time index $n_{fr}=0, \ldots, N_{fr}1$. Further, I indicates a time frame index, and the time frame index $I=0, \ldots, L-1$. Note that $N_{fr}$ is a frame size (the number of samples in a time frame), and L is the total number of frames.

Further, the frame size $N_{fr}$ is the number of samples $N_{fr}$ ($=R(f_s^T \times T_{fr})$, where R( ) is an arbitrary rounding function) corresponding to time $T_{fr}$[s] in one frame at a time sampling frequency $f_s^T$ [Hz]. While, in the present embodiment, for example, the time in one frame $T_{fr}=1.0$ [s], and the rounding function R( ) is round-off, they may be set differently. Further, while a shift amount of the frame is set at 50% of the frame size $N_{fr}$, it may be set differently.

Still further, while a square root of a Hanning window is used as the window function, other windows such as a Hamming window and a Blackman-Harris window may be used.

When the window function applied signal $s_w(n_{mic}, n_{fr}, l)$ is obtained in this manner, the time-frequency analysis unit 22 performs time-frequency transform on the window function applied signal $s_w(n_{mic}, n_{fr}, l)$ by calculating the following equations (3) and (4) to calculate a time-frequency spectrum $S(n_{mic}, n_T, l)$.

[Math. 3]

$$s'_w(n_{mic}, m_T, l) = \begin{cases} s_w(n_{mic}, m_T, l) & m_T = 0, \ldots, N_{fr}-1 \\ 0 & m_T = N_{fr}, \ldots, M_{fr}-1 \end{cases} \tag{3}$$

[Math. 4]

$$S(n_{mic}, n_T, l) = \sum_{m_1=0}^{M_T-1} s'_w(n_{mic}, m_T, l)\exp\left(-i2\pi\frac{m_T n_T}{M_T}\right) \tag{4}$$

That is, a zero padded signal $s_w'(n_{mic}, m_T, l)$ is obtained through calculation of the equation (3), and equation (4) is calculated based on the obtained zero padded signal $s_w'(n_{mic}, m_T, l)$ to calculate a time-frequency spectrum $S(n_{mic}, n_T, l)$.

Note that, in the equation (3) and the equation (4), $M_T$ indicates the number of points used for time-frequency transform. Further, $n_T$ indicates a time-frequency spectral index. Here, $N_T=M_T/2+1$, and $n_T=0, \ldots, N_T-1$. Further, in the equation (4), i indicates a pure imaginary number.

Further, while, in the present embodiment, time-frequency transform using short time Fourier transform (STFT) is performed, other time-frequency transform such as discrete cosine transform (DCT) and modified discrete cosine transform (MDCT) may be used.

Still further, while the number of points $M_T$ of STFT is set at a power-of-two value closest to $N_{fr}$, which is equal to or larger than $N_{fr}$, other number of points $M_T$ may be used.

The time-frequency analysis unit 22 supplies the time-frequency spectrum $S(n_{mic}, n_T, l)$ obtained through the above-described processing to the spatial frequency analysis unit 23.

(Spatial Frequency Analysis Unit)

Subsequently, the spatial frequency analysis unit 23 performs spatial frequency transform on the time-frequency spectrum $S(n_{mic}, n_T, l)$ supplied from the time-frequency analysis unit 22 by calculating the following equation (5) to calculate a spatial frequency spectrum $S_{SP}(n_S, n_T, l)$.

[Math. 5]

$$S_{SP}(n_S, n_T, l) = \frac{1}{M_S}\sum_{m_S=0}^{M_S-1} S'(m_S, n_T, l)\exp\left(i2\pi\frac{m_S n_S}{M_S}\right) \tag{5}$$

Note that, in the equation (5), $M_S$ indicates the number of points used for spatial frequency transform, and $m_s=0, \ldots, M_S-1$. Further, $S'(m_S, n_T, l)$ indicates a zero padded signal obtained by performing zero padding on the time-frequency spectrum $S(n_{mic}, n_T, l)$, and i indicates a pure imaginary number. Still further, $n_S$ indicates a spatial frequency spectral index.

In the present embodiment, spatial frequency transform through inverse discrete Fourier transform (IDFT) is performed through calculation of the equation (5).

Further, if necessary, it is also possible to appropriately perform zero padding according to the number of points $M_S$ of IDFT. In the present embodiment, assuming that the spatial sampling frequency of the signal obtained at the linear microphone array 21 is $f_s^S$ [Hz], zero padding corresponding to the number of points $M_S$ of IDFT is performed so that the lengths of the plurality of linear microphone arrays 21 (array lengths) $X=M_S/f_s^S$ become the same, and a reference length is set at the length of the linear microphone array 21 having the maximum array length $X_{max}$. However, the number of points $M_S$ may be determined based on other lengths.

Specifically, the spatial sampling frequency $f_s^S$ is determined by an interval between the microphones included in the linear microphone array 21, and the number of points $M_S$ is determined so that the array length $X=M_S/f_s^S$ becomes the array length $X_{max}$ with respect to this spatial sampling frequency $f_s^S$.

Concerning a point $m_S$ at which $0 \le m_S \le N_{mic}-1$, it is set that the zero padded signal $S'(m_S, n_T, l)$=a time-frequency spectrum $S(n_{mic}, n_T, l)$, and, concerning a point $m_S$ at which $N_{mic} \le m_S \le M_S-1$, it is set that the zero padded signal $S'(m_S, n_T, l)=0$.

Note that, at this point, while central coordinates of the respective linear microphone arrays 21 do not necessarily have to be the same, it is necessary to make the length $M_S/f_s^S$ of the respective linear microphone arrays 21 the same. The spatial sampling frequency $f_s^S$ or the number of points $M_S$ of IDFT becomes a value different for each linear microphone array 21.

The spatial frequency spectrum $S_{SP}(n_S, n_T, l)$ obtained through the above-described processing indicates what kind of waveforms a signal of the time-frequency $n_T$ included in a time frame I takes in space. The spatial frequency analysis unit 23 supplies the spatial frequency spectrum $S_{SP}(n_S, n_T, l)$ to the space shift unit 24.

(Space Shift Unit)

The space shift unit 24 spatially shifts the spatial frequency spectrum $S_{SP}(n_S, n_T, l)$ supplied from the spatial frequency analysis unit 23 in a direction horizontal to the linear microphone array 21, that is, in a direction the microphones included in the linear microphone array 21 are arranged to obtain a spatially shifted spectrum $S_{SFT}(n_S, n_T, l)$. That is, the space shift unit 24 makes central coordinates of the plurality of linear microphone arrays 21 the same so that sound fields recorded at the plurality of linear microphone arrays 21 can be mixed.

Specifically, the space shift unit 24 calculates the following equation (6) to perform space shift in a space domain by changing (shifting) a phase of the spatial frequency spectrum in a spatial frequency domain, thereby changing a phase in a time-frequency domain as a result of the space shift, so that time shift of the signal obtained at the linear microphone array 21 is realized in a time domain.

[Math. 6]

$$\begin{aligned} S_{SFT}(n_S, n_T, l) &= S_{SP}(n_S, n_T, l)\exp(ik_x x) \\ &= S_{SP}(n_S, n_T, l)\exp\left(i2\pi f_s^s \frac{n_S}{M_S} x\right) \end{aligned} \tag{6}$$

Note that, in the equation (6), $n_S$ indicates a spatial frequency spectral index, $n_T$ indicates a time-frequency spectral index, I indicates a time frame index, and i indicates a pure imaginary number.

Further, $k_x$ indicates a wavenumber [rad/m], and x indicates a space shift amount [m] of the spatial frequency spectrum $S_{SP}(n_S, n_T, l)$. Note that it is assumed that the space shift amount x of each spatial frequency spectrum $S_{SP}(n_S, n_T, l)$ is obtained in advance from positional relationship, or the like, of linear microphone arrays 21.

Still further, $f_s^S$ indicates a spatial sampling frequency [Hz], and $M_S$ indicates the number of points of IDFT. These wavenumber $k_x$, spatial sampling frequency $f_s^S$, the number of points $M_S$ and space shift amount x are values different for each linear microphone array 21.

In this manner, by shifting (performing phase shift) the spatial frequency spectrum $S_{SP}(n_S, n_T, l)$ by the space shift amount x in a spatial frequency domain, it is possible to arrange the central coordinates of the linear microphone arrays 21 at the same position more easily compared to a case where a temporal signal is shifted in a time direction.

The space shift unit 24 supplies the obtained spatially shifted spectrum $S_{SFT}(n_S, n_T, l)$ to the space domain signal mixing unit 25. Note that, in the following description, an identifier of each of the plurality of linear microphone arrays 21 is set at i, and a spatially shifted spectrum $S_{SFT}(n_S, n_T, l)$ for a linear microphone array 21 specified by the identifier i is also described as $S_{SFT_}i(n_S, n_T, l)$. Note that the identifier $i=0, \ldots, I-1$.

Note that it is only necessary to determine a spatial frequency spectrum of which linear microphone array 21 is spatially shifted among spatial frequency spectra $S_{SP}(n_S, n_T, l)$ of the plurality of linear microphone arrays 21 or its space shift amount according to positional relationship, or the like, of the linear microphone arrays 21. That is, it is only necessary to arrange central coordinates of the respective linear microphone arrays 21, in other words, central coordinates of sound fields (sound collection signals) collected by the linear microphone arrays 21 at the same position, and the spatial frequency spectra of all the linear microphone arrays 21 are not necessarily required to be spatially shifted.

(Space Domain Signal Mixing Unit)

The space domain signal mixing unit 25 mixes spatially shifted spectra $S_{SFT_}i(n_S, n_T, l)$ for the plurality of linear microphone arrays 21 supplied from the plurality of space shift units 24 by calculating the following equation (7) to calculate a single microphone mixed signal $S_{MIX}(n_S, n_T, l)$.

[Math. 7]

$$S_{MIX}(n_S, n_T, l) = \sum_{i=0}^{I-1} a_i(n_S, n_T) S_{SFT_i}(n_S, n_T, l) \tag{7}$$

Note that, in the equation (7), $a_i(n_S, n_T)$ indicates a mixing coefficient to be multiplied by each spatially shifted spectrum $S_{SFT_}i(n_S, n_T, l)$, and by performing weighted addition on the spatially shifted spectrum using this mixing coefficient $a_i(n_S, n_T)$, a microphone mixed signal is calculated.

Further, to calculate the equation (7), zero padding of spatially shifted spectra $S_{SFT_}i(n_S, n_T, l)$ is performed.

That is, while the array lengths X of spatially shifted spectra $S_{SFT_}i(n_S, n_T, l)$ distinguished by the identifier i of the linear microphone array 21 have been already made the same, the number of points $M_S$ for the spatial frequency transform are different.

Therefore, the space domain signal mixing unit 25 makes the number of points $M_S$ of the spatially shifted spectra $S_{SFT_}i(n_S, n_T, l)$ the same by, for example, performing zero padding on an upper limit frequency of the spatially shifted spectra $S_{SFT_}i(n_S, n_T, l)$ so as to match the linear microphone array 21 having a maximum spatial sampling frequency $f_s^S$ [Hz]. That is, by making the spatially shifted spectrum $S_{SFT_}i(n_S, n_T, l)$ in a predetermined spatial frequency $n_S$ zero as appropriate, zero padding is performed to make the number of points $M_S$ the same.

In the present embodiment, for example, by performing zero padding so as to match the maximum spatial frequency, the spatial sampling frequencies $f_s^S$ [Hz] are made the same.

However, the present embodiment is not limited to this, and, when, for example, only a microphone mixed signal up to a specific spatial frequency is transmitted to the sound field reproducing apparatus 42, values of the spatially shifted spectra $S_{SFT_}i(n_S, n_T, l)$ after the specific spatial frequency may be made 0 (zero). In this case, because it is not necessary to transmit an unnecessary spatial frequency component, it is possible to reduce transmission cost of the spatially shifted spectra.

For example, because spatial frequency bands of sound fields which can be reproduced are different depending on an interval of the speakers included in the linear speaker array 30, if the microphone mixed signal according to a reproduction environment of reproduction space is made to be transmitted, it is possible to improve transmission efficiency.

Further, a value of the mixing coefficient $a_i(n_S, n_T)$ to be used for weighted addition of the spatially shifted spectrum $S_{SFT_}i(n_S, n_T, l)$ depends on a time frequency $n_T$ and a spatial frequency $n_S$.

For example, while, in the present embodiment, the mixing coefficient $a_i(n_S, n_T)=1/I_c(n_S)$ assuming that gains of the respective linear microphone arrays 21 are adjusted to be substantially the same, the mixing coefficient may be other values. Note that $I_c(n_S)$ is the number of linear microphone arrays 21 in which the spatially shifted spectrum $S_{SFT_}i(n_S, n_T, l)$ is not a zero value in each spatial frequency band, that is, at the spatial frequency $n_S$. The mixing coefficient is made $a_i(n_S, n_T)=1/I_c(n_S)$ in order to calculate an average value among the linear micro arrays 21.

Further, for example, the mixing coefficient $a_i(n_S, n_T)$ may be determined while taking into account frequency characteristics of the microphones of the respective linear microphone arrays 21. For example, it is also possible to employ a configuration where, in a low frequency band, only a spatially shifted spectrum of the linear microphone array 21-1 is used to calculate the microphone mixed signal, while, in a high frequency band, only a spatially shifted spectrum of the linear microphone array 21-2 is used to calculate the microphone mixed signal.

Still further, for example, the mixing coefficient $a_i(n_S, n_T)$ of the linear microphone array 21 including microphones for which digital saturation is detected because sensitivity is too high with respect to a sound pressure may be made 0 (zero) while taking into account sensitivity of the microphones.

In addition, for example, when there is a defect in a specific microphone of a specific linear microphone array 21 and it is known that real wave fronts are not collected with the microphone, or when uncollected sound is confirmed through constant observation of an average value of signals, non-linear noise prominently appears in a high frequency band in a spatial frequency domain due to discontinuity among the microphones. Therefore, in such a case, a mixing coefficient $a_i(n_S, n_T)$ of the linear microphone array 21 having a defect may be designed to be a spatial low-pass filter.

Here, a specific example of zero padding to spatially shifted spectrum $S_{SFT_}i(n_S, n_T, l)$ described above will be described with reference to FIG. 4.

Figure 4:
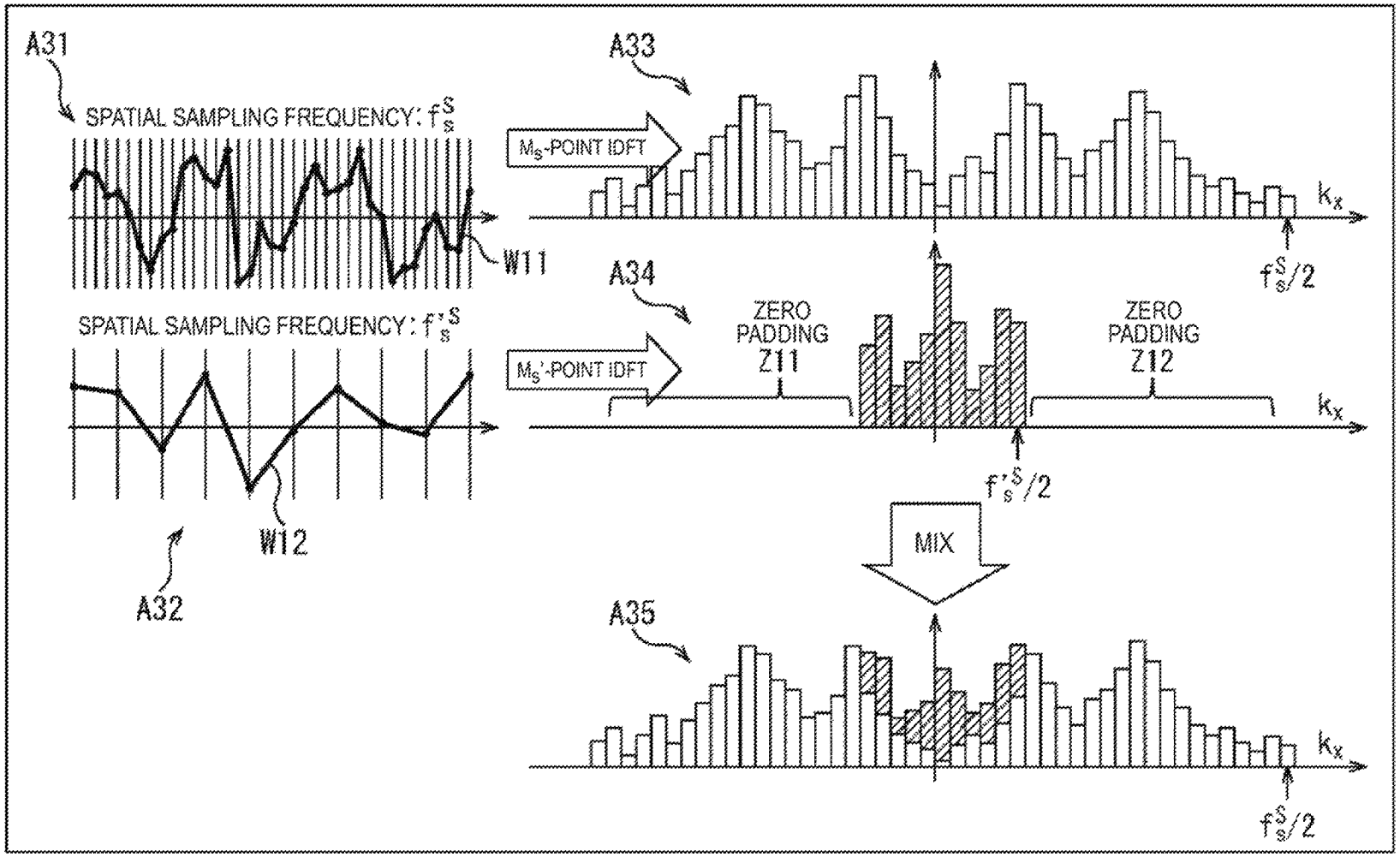
FIG. 4 is a diagram explaining zero padding in a spatial frequency according to an embodiment of the present technology.

For example, it is assumed that, as indicated with an arrow A31 in FIG. 4, sound wave fronts W11 are obtained through sound collection by the linear microphone array 21-1, and as indicated with an arrow A32, sound wave fronts W12 are obtained through sound collection by the linear microphone array 21-2.

Note that, in the wave fronts W11 and the wave fronts W12, in FIG. 4, a horizontal direction indicates positions in a direction the microphones of the linear microphone array 21 in real space are arranged, while a vertical direction in FIG. 4 indicates a sound pressure. Further, one circle on the wave fronts W11 and the wave fronts W12 represents a position of one microphone included in the linear microphone array 21.

In this example, because an interval between the microphones of the linear microphone array 21-1 is narrower than an interval between the microphones of the linear microphone array 21-2, a spatial sampling frequency $f_s^S$ of the wave fronts W11 is greater (higher) than a spatial sampling frequency $f_s'^S$ of the wave fronts W12.

Therefore, the number of points $M_S$ of respective spatially shifted spectra $S_{SFT}(n_S, n_T, l)$ obtained by performing spatial frequency transform (IDFT) on the time-frequency spectra obtained from the wave fronts W11 and the wave fronts W12 and further performing space shift become different.

In FIG. 4, the spatially shifted spectrum $S_{SFT}(n_S, n_T, l)$ indicated with an arrow A33 indicates a spatially shifted spectrum obtained from the wave fronts W11, and the number of points of the spatially shifted spectrum is $M_S$.

Meanwhile, a spatially shifted spectrum $S_{SFT}(n_S, n_T, l)$ indicated with an arrow A34 indicates a spatially shifted spectrum obtained from the wave fronts W12, and the number of points of the spatially shifted spectrum is $M_S'$.

Note that, in the spatially shifted spectra indicated with the arrow A33 and the arrow A34, a horizontal axis indicates a wavenumber $k_x$, while a vertical axis indicates a value of a spatially shifted spectrum at each wavenumber $k_x$, that is, each point (spatial frequency $n_S$), more specifically, an absolute value of frequency response.

The number of points of the spatially shifted spectrum is determined by the spatial sampling frequency of the wave fronts, and, in this example, because $f_s^S > f_s'^S$, the number of points $M_S'$ of the spatially shifted spectrum indicated with the arrow A34 is less than the number of points $M_S$ of the spatially shifted spectrum indicated with the arrow A33. That is, only components in a narrower frequency band are included as the spatially shifted spectrum.

In this example, there is no component of a frequency band in a part of Z11 and a part of Z12 in the spatially shifted spectrum indicated with the arrow A34.

Therefore, it is impossible to obtain the microphone mixed signal $S_{MIX}(n_S, n_T, l)$ by simply mixing these two spatially shifted spectra. Accordingly, the space domain signal mixing unit 25, for example, performs zero padding to the parts of Z11 and Z12 of the spatially shifted spectrum indicated with the arrow A34 to make the number of points of the two spatially shifted spectra the same. That is, 0 (zero) is set as a value of the spatially shifted spectrum $S_{SFT}(n_S, n_T, l)$ at each point (spatial frequency $n_S$) of the part of Z11 and the part of Z12.

The space domain signal mixing unit 25 then mixes the two spatially shifted spectra having the same number of points $M_S$ through zero padding by calculating the equation (7) to obtain a microphone mixed signal $S_{MIX}(n_S, n_T, l)$ indicated with an arrow A35. Note that, in the microphone mixed signal indicated with the arrow A35, a horizontal axis indicates a wavenumber $k_x$, while a vertical axis indicates a value of the microphone mixed signal at each point.

The space domain signal mixing unit 25 supplies the microphone mixed signal $S_{MIX}(n_S, n_T, l)$ obtained through the above-described processing to the communication unit 26 and makes the communication unit 26 transmit the signal. When the microphone mixed signal is transmitted/received by the communication unit 26 and the communication unit 27, the microphone mixed signal is supplied to the spatial resampling unit 28.

(Spatial Resampling Unit)

The spatial resampling unit 28 first calculates the following equation (8) based on the microphone mixed signal $S_{MIX}(n_S, n_T, l)$ supplied from the space domain signal mixing unit 25 to obtain a drive signal $D_{SP}(m_S, n_T, l)$ in a space region for reproducing a sound field (wave fronts) with the linear speaker array 30. That is, a drive signal $D_{SP}(m_S, n_T, l)$ is calculated using a spectral division method (SDM).

[Math. 8]

$$D_{SP}(m_S, n_T, l) = 4i\frac{\exp(-ik_{pw}y_{ref})}{H_0^{(2)}(k_{pw}y_{ref})}S_{MIX}(n_S, n_T, l). \tag{8}$$

Here, $k_{pw}$ in the equation (8) can be obtained from the following equation (9).

[Math. 9]

$$k_{pw} = \sqrt{\left(\frac{\omega}{c}\right)^2 - k_x^2} \tag{9}$$

Note that, in the equation (8), $y_{ref}$ indicates a reference distance of SDM, and the reference distance $y_{ref}$ is a position at which wave fronts are reproduced accurately. This reference distance $y_{ref}$ becomes a distance in a direction perpendicular to a direction the microphones of the linear microphone array 21 are arranged. For example, while the reference distance $y_{ref}$=1 [m] here, the reference distance may be other values. Further, in the present embodiment, an evanescent wave is ignored.

Still further, in the equation (8), $H_0^{(2)}$ indicates a Hankel function, and i indicates a pure imaginary number. Further, $m_S$ indicates a spatial frequency spectral index. Still further, in the equation (9), c indicates the speed of sound, and ω indicates a temporal radian frequency.

Note that, while a method for calculating a drive signal $D_{SP}(m_S, n_T, l)$ using SDM has been described here as an example, a drive signal may be calculated using other methods. Further, the SDM is described in detail, particularly, in "Jens Adrens, Sascha Spors, "Applying the Ambisonics Approach on Planar and Linear Arrays of Loudspeakers", in $2^{nd}$ International Symposium on Ambisonics and Spherical Acoustics".

Subsequently, the spatial resampling unit 28 performs inverse spatial frequency transform on the drive signal $D_{SP}(m_S, n_T, l)$ in a space domain by calculating the following equation (10) to calculate a time-frequency spectrum $D(n_{spk}, n_T, l)$. In the equation (10), discrete Fourier transform is performed as inverse spatial frequency transform.

[Math. 10]

$$D(n_{spk}, n_T, l) = \sum_{m_S=0}^{M_S-1} D_{SP}(m_S, n_T, l)\exp\left(-i2\pi\frac{m_S n_{spk}}{M_S}\right) \tag{10}$$

Note that, in the equation (10), $n_{spk}$ indicates a speaker index for specifying a speaker included in the linear speaker array 30. Further, $M_S$ indicates the number of points of DFT, and i indicates a pure imaginary number.

In the equation (10), the drive signal $D_{SP}(m_S, n_T, l)$ which is a spatial frequency spectrum is transformed into a time-frequency spectrum, while the drive signal (microphone mixed signal) is also resampled. Specifically, the spatial resampling unit 28 obtains a drive signal for the linear speaker array 30 which enables a sound field in real space to be reproduced by resampling (performing inverse spatial frequency transform) the drive signal at a spatial sampling frequency according to an interval of the speakers of the linear speaker array 30. Such resampling cannot be performed unless a sound field is collected at the linear microphone array.

The spatial resampling unit 28 supplies the time-frequency spectrum $D(n_{spk}, n_T, l)$ obtained in this manner to the time-frequency synthesis unit 29.

(Time-Frequency Synthesis Unit)

The time-frequency synthesis unit 29 performs time-frequency synthesis of the time-frequency spectrum $D(n_{spk}, n_T, l)$ supplied from the spatial resampling unit 28 by calculating the following equation (11) to obtain an output frame signal $d_{fr}(n_{spk}, n_{fr}, l)$. Here, while inverse short time Fourier transform (ISTFT) is used as time-frequency synthesis, it is only necessary to use transform corresponding to inverse transform of time-frequency transform (forward transform) performed at the time-frequency analysis unit 22.

[Math. 11]

$$d_{fr}(n_{spk}, n_{fr}, l) = \frac{1}{M_T}\sum_{m_T=0}^{M_T-1} D'(n_{spk}, m_T, l)\exp\left(i2\pi\frac{n_{fr}m_T}{M_T}\right) \quad (11)$$

Note that $D'(n_{spk}, M_T, l)$ in the equation (11) can be obtained through the following equation (12).

[Math. 12]

$$D'(n_{spk}, m_T, l) = \begin{cases} D(n_{spk}, m_T, l) & m_T = 0, \ldots, N_T - 1 \\ conj(D(n_{spk}, M_T - m_T, l)) & m_T = N_T, \ldots, M_T - 1 \end{cases} \quad (12)$$

In the equation (11), i indicates a pure imaginary number, and $n_{fr}$ indicates a time index. Further, in the equation (11) and the equation (12), $M_T$ indicates the number of points of ISTFT, and $n_{spk}$ indicates a speaker index.

Further, the time-frequency synthesis unit 29 multiplies the obtained output frame signal $d_{fr}(n_{spk}, n_{fr}, l)$ by a window function $w_T(n_{fr})$ and performs frame synthesis by performing overlap addition. For example, frame synthesis is performed through calculation of the following equation (13), and an output signal $d(n_{spk}, t)$ is obtained.

[Math. 13]

$$d^{diff}(n_{spk}, n_{fr}+lN_{fr}) = d_{fr}(n_{spk}, n_{fr}, l)w_T(n_{fr}) + d^{pref}(n_{spk}, n_{fr}+lN_{fr}) \quad (13)$$

Note that, while a window function which is the same as the window function used at the time-frequency analysis unit 22 is used as a window function $w_T(n_{fr})$ to be multiplied by the output frame signal $d_{fr}(n_{spk}, n_{fr}, l)$, the window function may be a rectangular window when the window is other windows such as a Hamming window.

Further, in the equation (13), while both $d^{prev}(n_{spk}, n_{fr}+lN_{fr})$ and $d^{diff}(n_{spk}, n_{fr}+lN_{fr})$ indicate an output signal $d(n_{spk}, t)$, $d^{prev}(n_{spk}, n_{fr}+lN_{fr})$ indicates a value prior to updating, and $d^{diff}(n_{spk}, n_{fr}+lN_{fr})$ indicates a value after updating.

The time-frequency synthesis unit 29 supplies the output signal $d(n_{spk}, t)$ obtained in this manner to the linear speaker array 30 as a speaker drive signal.

<Explanation of Sound Field Reproduction Processing>

Flow of processing performed by the sound field reproducer 11 described above will be described next. When the sound field reproducer 11 is instructed to collect wave fronts of sound in real space, the sound field reproducer 11 performs sound field reproduction processing for reproducing a sound field by collecting the wave fronts.

Figure 5:
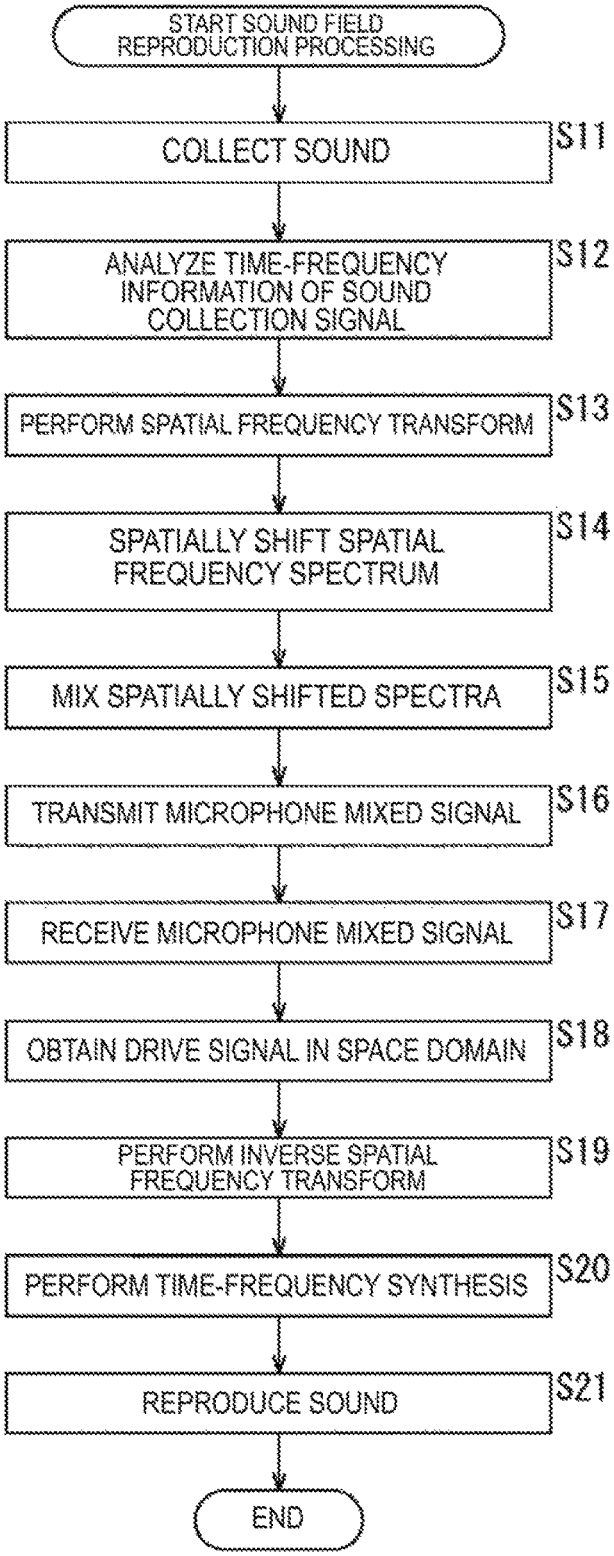
FIG. 5 is a flowchart explaining sound field reproduction processing according to an embodiment of the present technology.

The sound field reproduction processing by the sound field reproducer 11 will be described below with reference to the flowchart of FIG. 5.

In step S11, the linear microphone array 21 collects real wave fronts of sound in real space and supplies a sound collection signal obtained as a result of the sound collection to the time-frequency analysis unit 22.

Here, the sound collection signal obtained at the linear microphone array 21-1 is supplied to the time-frequency analysis unit 22-1, and the sound collection signal obtained at the linear microphone array 21-2 is supplied to the time-frequency analysis unit 22-2.

In step S12, the time-frequency analysis unit 22 analyzes time-frequency information of the sound collection signal $s(n_{mic}, t)$ supplied from the linear microphone array 21.

Specifically, the time-frequency analysis unit 22 performs time frame division on the sound collection signal $s(n_{mic}, t)$, multiplies an input frame signal $s_{fr}(n_{mic}, n_{fr}, l)$ obtained as a result of the time frame division by the window function $w_T(n_{fr})$ to calculate a window function applied signal $s_w(n_{mic}, n_{fr}, l)$.

Further, the time-frequency analysis unit 22 performs time-frequency transform on the window function applied signal $s_w(n_{mic}, n_{fr}, l)$ and supplies a time-frequency spectrum $S(n_{mic}, n_T, l)$ obtained as a result of the time-frequency transform to the spatial frequency analysis unit 23. That is, calculation of the equation (4) is performed to calculate the time-frequency spectrum $S(n_{mic}, n_T, l)$.

Here, the time-frequency spectra $S(n_{mic}, n_T, l)$ are respectively calculated at the time-frequency analysis unit 22-1 and the time-frequency analysis unit 22-2, and supplied to the spatial frequency analysis unit 23-1 and the spatial frequency analysis unit 23-2.

In step S13, the spatial frequency analysis unit 23 performs spatial frequency transform on the time-frequency spectrum $S(n_{mic}, n_T, l)$ supplied from the time-frequency analysis unit 22 and supplies a spatial frequency spectrum $S_{SP}(n_S, n_T, l)$ obtained as a result of the spatial frequency transform to the space shift unit 24.

Specifically, the spatial frequency analysis unit 23 transforms the time-frequency spectrum $S(n_{mic}, n_T, l)$ into the spatial frequency spectrum $S_{SP}(n_S, n_T, l)$ by calculating the equation (5). In other words, the spatial frequency spectrum is calculated by orthogonally transforming the time-frequency spectrum into the spatial frequency domain at a spatial sampling frequency $f_s^S$.

Here, the spatial frequency spectra $S_{SP}(n_S, n_T, l)$ are respectively calculated at the spatial frequency analysis unit 23-1 and the spatial frequency analysis unit 23-2 and supplied to the space shift unit 24-1 and the space shift unit 24-2.

In step S14, the space shift unit 24 spatially shifts the spatial frequency spectrum $S_{SP}(n_S, n_T, l)$ supplied from the spatial frequency analysis unit 23 by a space shift amount x and supplies a spatially shifted spectrum $S_{SFT}(n_S, n_T, l)$ obtained as a result of the space shift to the space domain signal mixing unit 25.

Specifically, the space shift unit 24 calculates a spatially shifted spectrum by calculating the equation (6). Here, spatially shifted spectra are respectively calculated at the space shift unit 24-1 and the space shift unit 24-2 and supplied to the space domain signal mixing unit 25.

In step S15, the space domain signal mixing unit 25 mixes the spatially shifted spectra $S_{SFT}(n_S, n_T, l)$ supplied from the space shift unit 24-1 and the space shift unit 24-2 and supplies a microphone mixed signal $S_{MIX}(n_S, n_T, l)$ obtained as a result of the mixture to the communication unit 26.

Specifically, the space domain signal mixing unit 25 calculates the equation (7) while performing zero padding to the spatially shifted spectrum $S_{SFT_i}(n_S, n_T, l)$ as necessary to calculate the microphone mixed signal.

In step S16, the communication unit 26 transmits the microphone mixed signal supplied from the space domain signal mixing unit 25 to the sound field reproducing apparatus 42 disposed in reproduction space through wireless communication. Then, in step S17, the communication unit 27 provided in the sound field reproducing apparatus 42 receives the microphone mixed signal transmitted through wireless communication and supplies the microphone mixed signal to the spatial resampling unit 28.

In step S18, the spatial resampling unit 28 obtains a drive signal $D_{SP}(m_S, n_T, l)$ in a space domain based on the microphone mixed signal $S_{MIX}(n_S, n_T, l)$ supplied from the communication unit 27. Specifically, the spatial resampling unit 28 calculates the drive signal $D_{SP}(m_S, n_T, l)$ by calculating the equation (8).

In step S19, the spatial resampling unit 28 performs inverse spatial frequency transform on the obtained drive signal $D_{SP}(m_S, n_T, l)$ and supplies a time-frequency spectrum $D(n_{spk}, n_T, l)$ obtained as a result of the inverse spatial frequency transform to the time-frequency synthesis unit 29. Specifically, the spatial resampling unit 28 transforms the drive signal $D_{SP}(m_S, n_T, l)$ which is a spatial frequency spectrum into a time-frequency spectrum $D(n_{spk}, n_T, l)$ by calculating the equation (10).

In step S20, the time-frequency synthesis unit 29 performs time-frequency synthesis of the time-frequency spectrum $D(n_{spk}, n_T, l)$ supplied from the spatial resampling unit 28.

Specifically, the time-frequency synthesis unit 29 calculates an output frame signal $d_{fr}(n_{spk}, n_T, l)$ from the time-frequency spectrum $D(n_{spk}, n_T, l)$ by performing calculation of the equation (11). Further, the time-frequency synthesis unit 29 performs calculation of the equation (13) by multiplying the output frame signal $d_{fr}(n_{spk}, n_{fr}, l)$ by the window function $w_T(n_{fr})$ to calculate an output signal $d(n_{spk}, t)$ through frame synthesis.

The time-frequency synthesis unit 29 supplies the output signal $d(n_{spk}, t)$ obtained in this manner to the linear speaker array 30 as a speaker drive signal.

In step S21, the linear speaker array 30 reproduces sound based on the speaker drive signal supplied from the time-frequency synthesis unit 29, and the sound field reproduction processing ends. When sound is reproduced based on the speaker drive signal in this manner, a sound field in real space is reproduced in reproduction space.

As described above, the sound field reproducer 11 transforms the sound collection signals obtained at the plurality of linear microphone arrays 21 into spatial frequency spectra and mixes these spatial frequency spectra after spatially shifting the spatial frequency spectra as necessary so that central coordinates become the same.

By obtaining a single microphone mixed signal by mixing the spatial frequency spectra obtained for the plurality of linear microphone arrays 21, it is possible to reproduce a sound field accurately at lower cost. That is, in this case, by using the plurality of linear microphone arrays 21, it is possible to reproduce a sound field accurately without the need of a linear microphone array which has high performance but is expensive, so that it is possible to suppress cost of the sound field reproducer 11.

Particularly, if a small linear microphone array is used as the linear microphone array 21, it is possible to improve spatial frequency resolution of the sound collection signals, and if linear microphone arrays having different characteristics are used as the plurality of linear microphone arrays 21, it is possible to expand a dynamic range or a frequency range.

Further, by obtaining a single microphone mixed signal by mixing spatial frequency spectra obtained for the plurality of microphone arrays 21, it is possible to reduce transmission cost of signals. Still further, by resampling the microphone mixed signal, it is possible to reproduce a sound field with the linear speaker array 30 which includes an arbitrary number of speakers or in which speakers are arranged at arbitrary intervals.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose personal computer or the like that is capable of executing various functions when various programs are installed.

Figure 6:
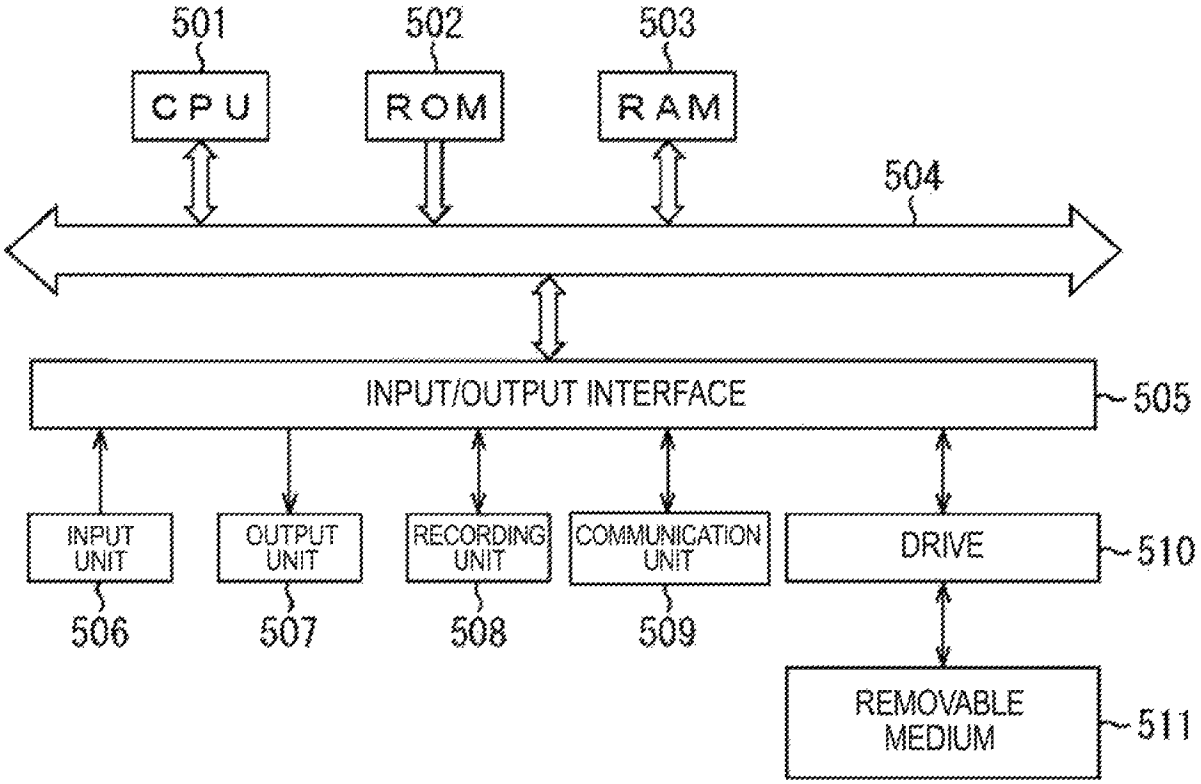
FIG. 6 is a diagram illustrating a configuration example of a computer according to an embodiment of the present technology.

FIG. 6 is a block diagram showing an example configuration of the hardware of a computer that executes the series of processes described earlier according to a program.

In a computer, a CPU (Central Processing Unit) 501, a ROM (Read Only Memory) 502, and a RAM (Random Access Memory) 503 are mutually connected by a bus 504.

An input/output interface 505 is also connected to the bus 504. An input unit 506, an output unit 507, a recording unit 508, a communication unit 509, and a drive 510 are connected to the input/output interface 505.

The input unit 506 is configured from a keyboard, a mouse, a microphone, an imaging device, or the like. The output unit 507 configured from a display, a speaker or the like. The recording unit 508 is configured from a hard disk, a non-volatile memory or the like. The communication unit 509 is configured from a network interface or the like. The drive 510 drives a removable medium 511 such as a magnetic disk, an optical disk, a magneto-optical disk, a semiconductor memory or the like.

In the computer configured as described above, as one example the CPU 501 loads a program stored in the recording unit 508 via the input/output interface 505 and the bus 504 into the RAM 503 and executes the program to carry out the series of processes described earlier.

As one example, the program executed by the computer (the CPU 501) may be provided by being recorded on the removable medium 511 as a packaged medium or the like. The program can also be provided via a wired or wireless transfer medium, such as a local area network, the Internet, or a digital satellite broadcast.

In the computer, by loading the removable medium 511 into the drive 510, the program can be installed into the recording unit 508 via the input/output interface 505. It is also possible to receive the program from a wired or wireless transfer medium using the communication unit 509 and install the program into the recording unit 508. As another alternative, the program can be installed in advance into the ROM 502 or the recording unit 508.

Note that the program executed by the computer may be a program in which processes are carried out in a time series in the order described in this specification or may be a program in which processes are carried out in parallel or at necessary timing, such as when the processes are called.

An embodiment of the disclosure is not limited to the embodiments described above, and various changes and modifications may be made without departing from the scope of the disclosure.

For example, the present disclosure can adopt a configuration of cloud computing which processes by allocating and connecting one function by a plurality of apparatuses through a network.

Further, each step described by the above-mentioned flow charts can be executed by one apparatus or by allocating a plurality of apparatuses.

In addition, in the case where a plurality of processes are included in one step, the plurality of processes included in this one step can be executed by one apparatus or by sharing a plurality of apparatuses.

In addition, the effects described in the present specification are not limiting but are merely examples, and there may be additional effects.

Additionally, the present technology may also be configured as below.

(1)

A sound field collecting apparatus including:

a first time-frequency analysis unit configured to perform time-frequency transform on a sound collection signal obtained through sound collection by a first linear microphone array including microphones having first characteristics to calculate a first time-frequency spectrum;

a first spatial frequency analysis unit configured to perform spatial frequency transform on the first time-frequency spectrum to calculate a first spatial frequency spectrum;

a second time-frequency analysis unit configured to perform time-frequency transform on a sound collection signal obtained through sound collection by a second linear microphone array including microphones having second characteristics different from the first characteristics to calculate a second time-frequency spectrum;

a second spatial frequency analysis unit configured to perform spatial frequency transform on the second time-frequency spectrum to calculate a second spatial frequency spectrum; and a space domain signal mixing unit configured to mix the first spatial frequency spectrum and the second spatial frequency spectrum to calculate a microphone mixed signal.

(2)

The sound field collecting apparatus according to (1), further including:

a space shift unit configured to shift a phase of the first spatial frequency spectrum according to positional relationship between the first linear microphone array and the second linear microphone array, wherein the space domain signal mixing unit mixes the second spatial frequency spectrum and the first spatial frequency spectrum whose phase is shifted.

(3)

The sound field collecting apparatus according to (1) or (2), wherein the space domain signal mixing unit performs zero padding on the first spatial frequency spectrum or the second spatial frequency spectrum so that the number of points of the first spatial frequency spectrum becomes the same as the number of points of the second spatial frequency spectrum.

(4)

The sound field collecting apparatus according to any one of (1) to (3), wherein the space domain signal mixing unit performs mixing by performing weighted addition on the first spatial frequency spectrum and the second spatial frequency spectrum using a predetermined mixing coefficient.

(5)

The sound field collecting apparatus according to any one of (1) to (4), wherein the first linear microphone array and the second linear microphone array are disposed on the same line.

(6)

The sound field collecting apparatus according to any one of (1) to (5), wherein the number of microphones included in the first linear microphone array is different from the number of microphones included in the second linear microphone array.

(7)

The sound field collecting apparatus according to any one of (1) to (6), wherein a length of the first linear microphone array is different from a length of the second linear microphone array.

(8)

The sound field collecting apparatus according to any one of (1) to (7), wherein an interval between the microphones included in the first linear microphone array is different from an interval between the microphones included in the second linear microphone array.

(9)

A sound field collecting method including steps of:

performing time-frequency transform on a sound collection signal obtained through sound collection by a first linear microphone array including microphones having first characteristics to calculate a first time-frequency spectrum;

performing spatial frequency transform on the first time-frequency spectrum to calculate a first spatial frequency spectrum;

performing time-frequency transform on a sound collection signal obtained through sound collection by a second linear microphone array including microphones having second characteristics different from the first characteristics to calculate a second time-frequency spectrum;

performing spatial frequency transform on the second time-frequency spectrum to calculate a second spatial frequency spectrum; and mixing the first spatial frequency spectrum and the second spatial frequency spectrum to calculate a microphone mixed signal.

(10)

A program causing a computer to execute processing including steps of:

performing time-frequency transform on a sound collection signal obtained through sound collection by a first linear microphone array including microphones having first characteristics to calculate a first time-frequency spectrum;

performing spatial frequency transform on the first time-frequency spectrum to calculate a first spatial frequency spectrum;

performing time-frequency transform on a sound collection signal obtained through sound collection by a second linear microphone array including microphones having second characteristics different from the first characteristics to calculate a second time-frequency spectrum;

performing spatial frequency transform on the second time-frequency spectrum to calculate a second spatial frequency spectrum; and mixing the first spatial frequency spectrum and the second spatial frequency spectrum to calculate a microphone mixed signal.

(11)

A sound field reproducing apparatus including:

a spatial resampling unit configured to perform inverse spatial frequency transform on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and a time-frequency synthesis unit configured to perform time-frequency synthesis on the time-frequency spectrum to generate a drive signal for reproducing a sound field by the linear speaker array.

(12)

A sound field reproducing method including steps of:

performing inverse spatial frequency transform on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and performing time-frequency synthesis on the time-frequency spectrum to generate a drive signal for reproducing a sound field by the linear speaker array.

(13)

A program causing a computer to execute processing including steps of:

performing inverse spatial frequency transform on a microphone mixed signal at a spatial sampling frequency determined by a linear speaker array to calculate a time-frequency spectrum, the microphone mixed signal being obtained by mixing a first spatial frequency spectrum calculated from a sound collection signal obtained through sound collection by a first linear microphone array including microphones having first characteristics and a second spatial frequency spectrum calculated from a sound collection signal obtained through sound collection by a second linear microphone array including microphones having second characteristics different from the first characteristics; and performing time-frequency synthesis on the time-frequency spectrum to generate a drive signal for reproducing a sound field by the linear speaker array.

REFERENCE SIGNS LIST

11 sound field reproducer
21-1, 21-2, 21 linear microphone array
22-1, 22-2, 22 time-frequency analysis unit
23-1, 23-2, 23 spatial frequency analysis unit
24-1, 24-2, 24 space shift unit
25 space domain signal mixing unit
28 spatial resampling unit
29 time-frequency synthesis unit
30 linear speaker array

The invention claimed is:

1. A sound field collecting apparatus, comprising:

a first time-frequency analysis unit configured to calculate a first time-frequency spectrum based on a time-frequency transform on a first sound signal, wherein the first sound signal is obtained through sound collection by a first linear microphone array, and wherein the first linear microphone array includes a first number of microphones having first characteristics;

a first spatial frequency analysis unit configured to calculate a first spatial frequency spectrum based on a first spatial frequency transform on the first time-frequency spectrum;

a second time-frequency analysis unit configured to calculate a second time-frequency spectrum based on a time frequency transform on a second sound signal, wherein the second sound signal is obtained through sound collection by a second linear microphone array, and wherein the second linear microphone array includes a second number of microphones having second characteristics different from the first characteristics;

a second spatial frequency analysis unit configured to calculate a second spatial frequency spectrum based on a second spatial frequency transform on the second time-frequency spectrum;

a space shift unit configured to shift a phase of the first spatial frequency spectrum and a phase of the second spatial frequency spectrum to obtain a phase-shifted first spatial frequency spectrum and a phase-shifted second spatial frequency spectrum; and a space domain signal mixing unit configured to mix the phase-shifted first spatial frequency spectrum and the phase-shifted second spatial frequency spectrum to calculate a microphone mixed signal.

2. The sound field collecting apparatus according to claim 1, wherein the space shift unit is configured to:

shift the phase of the first spatial frequency spectrum based on a positional relationship between the first linear microphone array and the second linear microphone array; and transmit the phase-shifted first spatial frequency spectrum to the space domain signal mixing unit.

3. The sound field collecting apparatus according to claim 1, wherein the space domain signal mixing unit is further configured to equalize a number of points of the phase-shifted first spatial frequency spectrum with a number of points of the phase-shifted second spatial frequency spectrum based on a zero padding process on the phase-shifted first spatial frequency spectrum or the phase-shifted second spatial frequency spectrum.

4. The sound field collecting apparatus according to claim 1, wherein the space domain signal mixing unit is further configured to mix the phase-shifted first spatial frequency spectrum and the phase-shifted second spatial frequency spectrum based on weighted addition on the phase-shifted first spatial frequency spectrum and the phase-shifted second spatial frequency spectrum, and wherein the weighted addition is based on a specific mixing coefficient.

5. The sound field collecting apparatus according to claim 1, wherein the first linear microphone array and the second linear microphone array are on the same line.

6. The sound field collecting apparatus according to claim 1, wherein the first number of microphones included in the first linear microphone array is different from the second number of microphones included in the second linear microphone array.

7. The sound field collecting apparatus according to claim 1, wherein a length of the first linear microphone array is different from a length of the second linear microphone array, and wherein the length of the first linear microphone array is a distance between a first microphone of the first number of microphones and a last microphone of the first number of microphones and the length of the second linear microphone array is a distance between a first microphone of the second number of microphones and a last microphone of the second number of microphones.

8. The sound field collecting apparatus according to claim 1, wherein a first interval between the first number of microphones included in the first linear microphone array is different from a second interval between the second number of microphones included in the second linear microphone array.

9. A sound field collecting method, comprising:

calculating a first time-frequency spectrum based on a time-frequency transform on a first sound signal, wherein the first sound signal is obtained through sound collection by a first linear microphone array, and wherein the first linear microphone array includes a first number of microphones having first characteristics;

calculating a first spatial frequency spectrum based on a first spatial frequency transform on the first time-frequency spectrum;

calculating a second time-frequency spectrum based on a time frequency transform on a second sound signal, wherein the second sound signal is obtained through sound collection by a second linear microphone array, and wherein the second linear microphone array includes a second number of microphones having second characteristics different from the first characteristics;

calculating a second spatial frequency spectrum based on a second spatial frequency transform on the second time-frequency spectrum;

shifting a phase of the first spatial frequency spectrum and a phase of the second spatial frequency spectrum to obtain a phase-shifted first spatial frequency spectrum and a phase-shifted second spatial frequency spectrum; and mixing the phase-shifted first spatial frequency spectrum and the phase-shifted second spatial frequency spectrum to calculate a microphone mixed signal.

10. A non-transitory computer-readable medium having stored thereon computer-executable instructions, that when executed by a processor of a computer, cause the computer to execute operations, the operations comprising:

calculating a first time-frequency spectrum based on a time-frequency transform on a first sound signal, wherein the first sound signal is obtained through sound collection by a first linear microphone array, and wherein the first linear microphone array includes a first number of microphones having first characteristics;

calculating a first spatial frequency spectrum based on a first spatial frequency transform on the first time-frequency spectrum;

calculating a second time-frequency spectrum based on a time frequency transform on a second sound signal, wherein the second sound signal is obtained through sound collection by a second linear microphone array, and wherein the second linear microphone array includes a second number of microphones having second characteristics different from the first characteristics;

calculating a second spatial frequency spectrum based on a second spatial frequency transform on the second time-frequency spectrum;

shifting a phase of the first spatial frequency spectrum and a phase of the second spatial frequency spectrum to obtain a phase-shifted first spatial frequency spectrum and a phase-shifted second spatial frequency spectrum; and mixing the phase-shifted first spatial frequency spectrum and the phase-shifted second spatial frequency spectrum to calculate a microphone mixed signal.

11. A sound field reproducing apparatus, comprising:

a spatial resampling unit configured to calculate a time-frequency spectrum based on an inverse spatial frequency transform on a microphone mixed signal at a spatial sampling frequency, wherein the spatial sampling frequency corresponds to a distance between endpoints of a linear speaker array, and wherein the microphone mixed signal is obtained based on a mixing operation to mix a phase-shifted first spatial frequency spectrum calculated from a first sound signal and a phase-shifted second spatial frequency spectrum calculated from a second sound signal, wherein the first sound signal is obtained through sound collection by a first linear microphone array that includes a first number of microphones having first characteristics, and the second sound signal is obtained through sound collection by a second linear microphone array that includes a second number of microphones having second characteristics different from the first characteristics; and a time-frequency synthesis unit configured to generate a drive signal, for reproduction of a sound field by the linear speaker array, based on a time frequency synthesis on the time-frequency spectrum.

12. A sound field reproducing method, comprising:

calculating a time-frequency spectrum based on an inverse spatial frequency transform on a microphone mixed signal at a spatial sampling frequency, wherein the spatial sampling frequency corresponds to a distance between endpoints of a linear speaker array, and wherein the microphone mixed signal is obtained by mixing a phase-shifted first spatial frequency spectrum calculated from a first sound signal and a phase-shifted second spatial frequency spectrum calculated from a second sound signal, wherein the first sound signal is obtained through sound collection by a first linear microphone array that include a first number of microphones having first characteristics, and the second sound signal is obtained through sound collection by a second linear microphone array including a second number of microphones having second characteristics different from the first characteristics; and generating a drive signal, for reproducing a sound field by the linear speaker array, based on time frequency synthesis on the time-frequency spectrum.

13. A non-transitory computer-readable medium having stored thereon computer-executable instructions, that when executed by a processor, cause a computer to execute operations, the operations comprising:

calculating a time-frequency spectrum based on an inverse spatial frequency transform on a microphone mixed signal at a spatial sampling frequency, wherein the spatial sampling frequency corresponds to a distance between endpoints of a linear speaker array, and wherein the microphone mixed signal is obtained by mixing a phase-shifted first spatial frequency spectrum calculated from a first sound signal and a phase-shifted second spatial frequency spectrum calculated from a second sound signal, wherein the first sound signal is obtained through sound collection by a first linear microphone array that includes a first number of microphones having first characteristics, and the second sound signal is obtained through sound collection by a second linear microphone array including a second number of microphones having second characteristics different from the first characteristics; and generating a drive signal, for reproducing a sound field by the linear speaker array, based on time frequency synthesis on the time-frequency spectrum.

* * * * *